US011840821B2

(12) United States Patent
Reymond et al.

(10) Patent No.: US 11,840,821 B2
(45) Date of Patent: Dec. 12, 2023

(54) REMOVABLE TOOL ASSEMBLY FOR CONSTRUCTION MACHINES

(71) Applicant: VOLVO CONSTRUCTION EQUIPMENT AB, Eskilstuna (SE)

(72) Inventors: Didier Reymond, Virignin (FR); Gregory Arnal, Avressieux (FR); Edgar Bond, Vatilieu (FR)

(73) Assignee: VOLVO CONSTRUCTION EQUIPMENT AB, Eskilstuna (SE)

( * ) Notice: Subject to any disclaimer, the term of this patent is extended or adjusted under 35 U.S.C. 154(b) by 551 days.

(21) Appl. No.: 17/050,448

(22) PCT Filed: Apr. 27, 2018

(86) PCT No.: PCT/EP2018/060862
§ 371 (c)(1),
(2) Date: Oct. 25, 2020

(87) PCT Pub. No.: WO2019/206425
PCT Pub. Date: Oct. 31, 2019

(65) Prior Publication Data

US 2021/0140138 A1 May 13, 2021

(51) Int. Cl.
*E02F 3/36* (2006.01)
*E02F 3/413* (2006.01)
*E02F 3/96* (2006.01)

(52) U.S. Cl.
CPC ..... *E02F 3/3618* (2013.01); *E02F 3/3622* (2013.01); *E02F 3/3668* (2013.01);
(Continued)

(58) Field of Classification Search
CPC ... E02F 3/96; E02F 3/961; E02F 3/932; E02F 3/963; E02F 3/964; E02F 3/965;
(Continued)

(56) References Cited

U.S. PATENT DOCUMENTS 4,087,010 A * 5/1978 Stormon ..... E02F 3/966 414/722
4,100,688 A * 7/1978 Grist ..... E02F 3/3631 404/127
(Continued)

FOREIGN PATENT DOCUMENTS

CN 102359139 A 2/2012
EP 2055842 A2 5/2009
(Continued)

OTHER PUBLICATIONS

Search Report dated Feb. 15, 2022, Chinese Patent Application No. 201880089342.1, 17 pages.
(Continued)

*Primary Examiner* — Jamie L McGowan
(74) *Attorney, Agent, or Firm* — Sage Patent Group

(57) ABSTRACT

A removable tool assembly for a backhoe digging apparatus of a construction equipment machine having spaced apart parallel first and second fastening pins is disclosed. The removable tool assembly includes an attachment mechanism for releasably attaching the removable tool assembly onto the backhoe digging apparatus, the attachment mechanism including: a first attachment element having first receiving areas adapted to receive the first fastening pin, and a second attachment element having second receiving areas adapted to receive the second fastening pin, wherein the second attachment element is movable relative to the first attachment element between a first position, in which the first and second fastening pins can be removed from the first and second receiving areas.

20 Claims, 10 Drawing Sheets

(52) U.S. Cl.
CPC ..... *E02F 3/3672* (2013.01); *E02F 3/4135* (2013.01); *E02F 3/964* (2013.01); *E02F 3/965* (2013.01); *E02F 3/3654* (2013.01)

(58) Field of Classification Search
CPC . E02F 3/966; E02F 3/967; E02F 3/413; E02F 3/3618; E02F 3/3604; E02F 3/3622; E02F 3/3631; E02F 3/365; E02F 3/3627; E02F 3/3668; E02F 3/3672; E02F 3/4135
See application file for complete search history.

(56) References Cited

U.S. PATENT DOCUMENTS 4,116,346 A * 9/1978 Uchida ..... E02F 3/3618 414/723
4,355,945 A * 10/1982 Pilch ..... E02F 3/3618 414/723
4,810,162 A * 3/1989 Foster ..... E02F 3/3618 292/216
4,974,349 A * 12/1990 Timmons ..... E02D 3/026 37/379
5,111,602 A * 5/1992 Risch ..... E02F 3/404 414/722
5,145,313 A * 9/1992 Weyer ..... E02F 3/3677 37/468
5,242,258 A * 9/1993 Weyer ..... E02F 3/3618 37/468
5,333,400 A * 8/1994 Sonerud ..... E02F 3/3663 37/468
5,456,028 A 10/1995 Larson
5,465,513 A * 11/1995 Sonerud ..... E02F 3/3654 37/468
5,553,408 A * 9/1996 Townsend ..... E02F 3/404 414/722
5,678,332 A * 10/1997 Hawkins ..... E02F 3/965 414/722
5,695,017 A * 12/1997 Gessner ..... E21B 19/08 175/203
6,023,863 A * 2/2000 Mahin ..... E02F 3/963 37/454
6,041,529 A 3/2000 Ruvang
6,209,237 B1 * 4/2001 Heiple ..... E02F 3/404 414/722
6,311,417 B1 * 11/2001 Pratt ..... E02F 3/962 37/454
6,405,460 B1 * 6/2002 Whitmire ..... E02F 5/10 37/405
6,422,805 B1 * 7/2002 Miller ..... E02F 3/365 37/468
6,625,909 B1 * 9/2003 Miller ..... E02F 3/3622 37/468
6,659,709 B1 * 12/2003 Anderson ..... E02F 3/962 414/724
8,763,715 B2 * 7/2014 Osgood ..... E01H 5/067 37/231
10,113,301 B2 * 10/2018 Hedlund ..... F16C 11/10
2003/0024138 A1 * 2/2003 Frigon ..... E02F 3/404 37/406
2014/0283422 A1 * 9/2014 Cloutier ..... E02F 3/3686 280/504
2015/0042113 A1 * 2/2015 Cloutier ..... E02F 3/3618 294/68.1
2016/0177538 A1 * 6/2016 Seljestad ..... E02F 3/404 37/406
2017/0159264 A1 * 6/2017 Miyazaki ..... E02F 3/964
2017/0335540 A1 * 11/2017 Hill ..... E02F 3/3663
2018/0002888 A1 * 1/2018 Doyle ..... E02F 3/961
2021/0131057 A1 * 5/2021 Miller ..... E02F 3/3663
2021/0140138 A1 * 5/2021 Reymond ..... E02F 3/365
2023/0128543 A1 * 4/2023 Mitchell ..... E02F 3/4135 37/406

FOREIGN PATENT DOCUMENTS

WO WO 83/01473 A1 4/1983
WO WO 93/00486 A1 1/1993
WO WO 93/01366 A1 1/1993
WO WO 12/156672 A1 11/2012

OTHER PUBLICATIONS

International Search Report and Written Opinion of the International Searching Authority, PCT/EP2018/060862, dated Apr. 15, 2019, 20 pages.

* cited by examiner

REMOVABLE TOOL ASSEMBLY FOR CONSTRUCTION MACHINES

CROSS REFERENCE TO RELATED APPLICATIONS

This application is a 35 U.S.C. § 371 national stage application of PCT International Application No. PCT/EP2018/060862 filed on Apr. 27, 2018, the disclosure and content of which is incorporated by reference herein in its entirety.

TECHNICAL FIELD

The invention relates to detachable thumb assemblies for construction machines. Detachable thumb assemblies may be attached to the backhoe digging apparatus of machines such as excavators or backhoe loaders, where they can be used in conjunction with a main implement mounted on said digging apparatus, such as an excavating bucket or a hammer.

BACKGROUND ART

Many construction equipment machines are backhoe machine. A backhoe machine is an equipment where a work implement, primarily a bucket, is mounted at the end of a digging apparatus, the digging apparatus being itself mounted on a chassis of machine. The digging apparatus usually comprises at least a boom, which is articulated to the chassis through at least around a horizontal axis, and very often also around a vertical axis, and a dipper which is articulated at the free end of the boom around another horizontal axis. The dipper may also be articulated with respect to the boom around a vertical axis. Each of these movements is controlled by a power cylinder, usually a hydraulic cylinder, respectively a boom cylinder for controlling the movement of the boom relative to the chassis and a dipper cylinder for controlling the movement of the dipper relative to the boom. The bucket is articulated to the dipper around another horizontal axis and is controlled by another cylinder. In a backhoe machine, the digging apparatus can be controlled to pull back material towards the chassis of the machine.

In some cases, the dipper part of the digging apparatus is extendible, whereby it comprises a proximal part articulated to the boom and a distal part which is slidingly connected to the proximal part so as to form a length-adjustable dipper assembly. A cylinder is in most cases provided for adjusting the relative position of the two parts of the dipper. A slide mechanism is provided for connecting the two parts of the dipper in such a way that the two parts may slide relative one to the other along a longitudinal direction but that they are otherwise rigidly connected along all other directions. Of course, the work implement of the backhoe machine is then connected to the forward end of the distal part of the extendible dipper assembly.

In some cases, the proximal and distal parts are arranged so that, in cross-section, the distal part is essentially received within the proximal part, which can exhibit a hollow box cross-section. When the extendible dipper assembly is in a retracted position, only a forward extremity of the distal part emerges out of the proximal part, so as to be as compact as possible, thereby maximizing the length ratio of the assembly between its fully extended and fully retracted positions.

It is also known to provide a construction equipment machine with a detachable thumb assembly which can be mounted on the machine's digging apparatus. Such an assembly is useful for grabbing material between the main work implement and said thumb, as the thumb is used in opposition to the other fingers in the case of a human hand. While some thumb assemblies have a fixed position with respect to the apparatus, or a position which can only be adjusted during a non-use phase of the machine, many thumb assemblies provide a controllable thumb where the position of the thumb with respect to the digging apparatus may be adjusted during a work phase of the machine. Such control is most often governed by a hydraulic cylinder which extends between the apparatus and the thumb.

As a thumb may be of use during only a fraction of a construction equipment machine operational life, it is desirable to make said thumb detachable. Thus, when not needed, the thumb can be uncoupled, thereby removing an unnecessary weight from the machine.

Prior art document U.S. Pat. No. 4,375,345 discloses a detachable thumb assembly mounted on a non-extendible dipper. The assembly comprises an arm link which is pivotally connected to a pair of mounting plates. The thumb is pivotally connected to the mounting plates around the same axis as the arm link, said axis being offset from the bucket pivoting axis. The mounting plates engage a bucket pivot pin and a link pivot pin in an abutting relation. Attachment of the assembly is achieved by the arm link which engages a lower side of the dipper through an abutment portion and through a lock bolt. The thumb cylinder is connected to the arm link at its back end, while its rod front end is connected to the thumb, near the free end thereof.

In this technical context, an object of the invention to propose a new design of a detachable thumb assembly, which can be coupled to a construction equipment machine with minimal user intervention.

SUMMARY

The invention provides a removable tool assembly for a backhoe digging apparatus of a construction equipment machine having spaced apart parallel first and second fastening pins, said removable tool assembly comprising an attachment mechanism for releasably attaching said removable tool assembly onto the backhoe digging apparatus, the attachment mechanism comprising:

- a first attachment element having first receiving areas adapted to receive the first fastening pin, and
- a second attachment element having second receiving areas adapted to receive the second fastening pin,
  - wherein the second attachment element is movable relative to the first attachment element between a first position, in which the first and second fastening pins can be removed from the first and second receiving areas, and a second position, in which the first and/or second fastening pins are tightly retained in the first and/or second receiving areas, and
  - wherein the first and second receiving areas are closer in said second position than in said first position.

Thus configured, the removable tool assembly of the present invention permits to be releasably and securely attached to a backhoe digging apparatus via only two fastening pins. This configuration is thus relatively simple and can be adapted to any removable tool assembly equipping the backhoe digging apparatus.

According to one embodiment, the removable tool assembly further comprises driving means adapted to move the second attachment element from the first position thereof to the second position thereof and vice versa.

According to a further embodiment, the first, respectively the second, receiving areas are defined by C-shaped portions of the first, respectively the second, attachment element, said C-shaped portions defining openings through which can be inserted the first, respectively the second, fastening pin into the first, respectively the second, receiving areas.

According to a further embodiment, the openings respectively defined by the C-shaped portions of the first and second attachment elements are oriented toward each other.

Thus configured, the removable tool assembly of the present invention can be easily attached, without human intervention, on the backhoe digging apparatus. In particular, in a preliminary attachment step, the removable tool assembly can be easily grabbed and lifted up by the dipper arm of the apparatus by engaging the first fastening pins inside the first receiving areas and by raising up and inclining the dipper arm to a position wherein first and second fastening pins are respectively engaged inside first and second receiving areas. During this preliminary attachment step, the driver does not need to exit from his cabin and does not need to operate manually the removable tool assembly. Only a human intervention may be needed in a final attachment step to move the second attachment element from the first position thereof to the second position thereof.

According to a further embodiment, the driving means comprise a spring structure resiliently biasing the second attachment element toward the second position thereof and a locking cam pivotally connected to the first attachment element and maintained in contact with the second attachment elements by said spring structure, said locking cam being movable between an unlocking position, in which the second attachment element is in the first position thereof, and a locking position, in which the second attachment element is in the second position thereof.

According to a further embodiment, the locking cam is integral with a pivot axle pivotally connected to the first attachment element, said pivot axle defining a pivot axis and being adapted to be temporarily connected to a lever, a pivoting movement of the lever around said pivot axis leading the locking cam to move from the locking position thereof to the unlocking position thereof or vice versa.

According to a further embodiment, the second attachment element comprises third receiving areas adapted to receive the first fastening pin in the second position of the second attachment element.

According to a further embodiment, the third receiving areas are defined by C-shaped portions of the second attachment element, said C-shaped portions defining openings through which can be inserted the first fastening pin into the third receiving areas, said openings being oriented toward the openings defined by the C-shaped portions of the first attachment element.

Thus configured, the removable tool assembly of the present invention can be safely attached on the backhoe digging apparatus, the C-shaped portions of the second attachment element defining the third receiving areas preventing that the first fastening pin moves out from the first receiving areas.

According to a further embodiment, each C-shaped portion of the first attachment element comprises a first end, against which abuts the first fastening pin in an initial position of the removable tool assembly, and a second end, against which abuts the first fastening pin in a final position of the removable tool assembly.

According to a further embodiment, each C-shaped portion of the first attachment element comprises a linking surface joining the first end to the second end, said linking surface defining a guiding path for the first fastening pin during the transfer of the removable tool assembly from the initial position to the final position.

Thus configured, the removable tool assembly of the present invention can be easily and rapidly transferred from its initial position to its final position.

According to a further embodiment, the driving means comprise a locking cam pivotally connected to the first attachment element and in contact with an abutment surface of the second attachment element, said locking cam being movable between an unlocking position, in which the second attachment element is in the first position thereof, and a locking position, in which the second attachment element is in the second position thereof.

According to a further embodiment, the locking cam comprises at least one first through-hole, and preferably a series of first through holes, adapted to receive a locking pin in the locking position thereof, said first through-hole, or through holes, being aligned with a corresponding through-hole, or through-holes, formed inside the second attachment element in said locking position, a movement of the locking cam relative to the first attachment element being thus prevented when the locking pin is received in said first through-hole, or through-holes, and said corresponding through-hole, or through-holes.

According to a further embodiment, the locking cam comprises at least one second through-hole adapted to receive a locking pin in the unlocking position thereof, said second through-hole being aligned with a corresponding through-hole formed inside the second attachment element in said unlocking position, a movement of the locking cam relative to the first attachment element being thus prevented when the locking pin is received in said second through-hole and said corresponding through-hole.

According to a further embodiment, the locking cam comprises at least one third through-hole adapted to receive a mounting end of a lever, said lever permitting to a user to manually move the locking cam from the unlocking position thereof to the locking position thereof and vice versa when the mounting end is received in the third through-hole.

According to a further embodiment, the first, respectively the second, attachment element comprises a U-shaped portion having two parallel flanges connected by a bottom plate, the U-shaped portions of the first and second attachment elements sliding one into the other.

Thus configured, the removable tool assembly of the present invention has a simple design that is adapted to the shape of the dipper arm. This may advantageously contribute to reduce the dimensions of the backhoe digging apparatus.

According to a further embodiment, the first and/or the second receiving areas are formed by cut-out portions of the flanges of the U-shaped portions and the driving means are part of and/or connected to the bottom plates of said U-shaped portions According to a further embodiment, the driving means is at least partially located on a side of the bottom plates that is opposite to the flanges.

According to a further embodiment, the driving means are a locking cam, said locking cam being located on a side of the bottom plates that is opposite to the flanges.

Thus configured, the removable tool assembly of the present invention has a even simpler design. Furthermore, this also avoids overhang problems that would occur if the locking cam was located on the same side as the flanges. Such overhang problems may result in blocking problems of the sliding connection between the first and second attachment element.

According to a further embodiment, the bottom plates of the U-shaped portions of the first and second attachment elements are close to each other, thus limiting the extension of the removable tool assembly in a direction perpendicular to said bottom plates.

The invention further provides a backhoe digging apparatus for a construction equipment machine comprising a dipper arm, said dipper arm having spaced apart parallel first and second fastening pins, and at least one removable tool assembly according to the present invention attached to said first and second fastening pins.

According to an embodiment, the removable tool assembly is chosen among a ripping tooth assembly, a compactor assembly, a cutter assembly, a splitter assembly, a rake assembly, a bucket assembly and a thumb assembly comprising a thumb.

According to a further embodiment, the attachment mechanism comprises a pair of lugs adapted to pivotally attach a tool, for instance an articulated thumb, the axis defined by the lugs being aligned with the axis defined by the second fastening pin.

Thus configured, a rotating and/or sliding displacement of the load lifted by the backhoe digging apparatus may advantageously be avoided.

The invention further provides a method for attaching a tool to a dipper arm of a backhoe digging apparatus of a construction equipment machine, said dipper arm having spaced apart parallel first and second fastening pins, the method comprising the following steps of:

a) moving the dipper arm to position the first fastening pin in an initial position in which said first fastening pin is received in first receiving areas of a first attachment element of the tool;

b) rotating the dipper arm so that the tool pivots relative to the dipper arm about the first fastening pin till a second attachment element of the tool abuts against the second fastening pin;

c) optionally, further rotating the dipper arm so that the first fastening pin moves along a guiding path defined by the first attachment element and reaches a final position in the first receiving areas;

d) moving the second attachment element relative to the first attachment element to position the second fastening pin in a final position in which said second fastening pin is received in second receiving areas of the second attachment element;

e) optionally, locking the second attachment element to the first attachment element.

According to an embodiment, the step d) comprises the steps of:

d1) connecting a lever to a locking cam that is pivotally connected to the first attachment element and is maintained in contact with the first and second attachment elements by a spring structure;

d2) rotating the lever to pivot the locking cam in a locking position in which the spring structure pushes the second attachment element toward the first attachment element till the second fastening pin is received in the second receiving areas of the second attachment element.

According to a further embodiment, the step d) comprises the steps of:

d1') connecting a lever to a locking cam that is pivotally connected to the first attachment element and in contact with an abutment surface of the second attachment element;

d2') rotating the lever to pivot the locking cam in a locking position in which said locking cam pushes the second attachment element toward the first attachment element till the second fastening pin is received in the second receiving areas of the second attachment element.

Further advantages and advantageous features of the invention are disclosed in the following description and in the dependent claims.

BRIEF DESCRIPTION OF THE DRAWINGS

With reference to the appended drawings, below follows a more detailed description of embodiments of the invention cited as examples.

In the drawings.

DETAILED DESCRIPTION OF EXAMPLE EMBODIMENTS OF THE INVENTION

Figure 1:
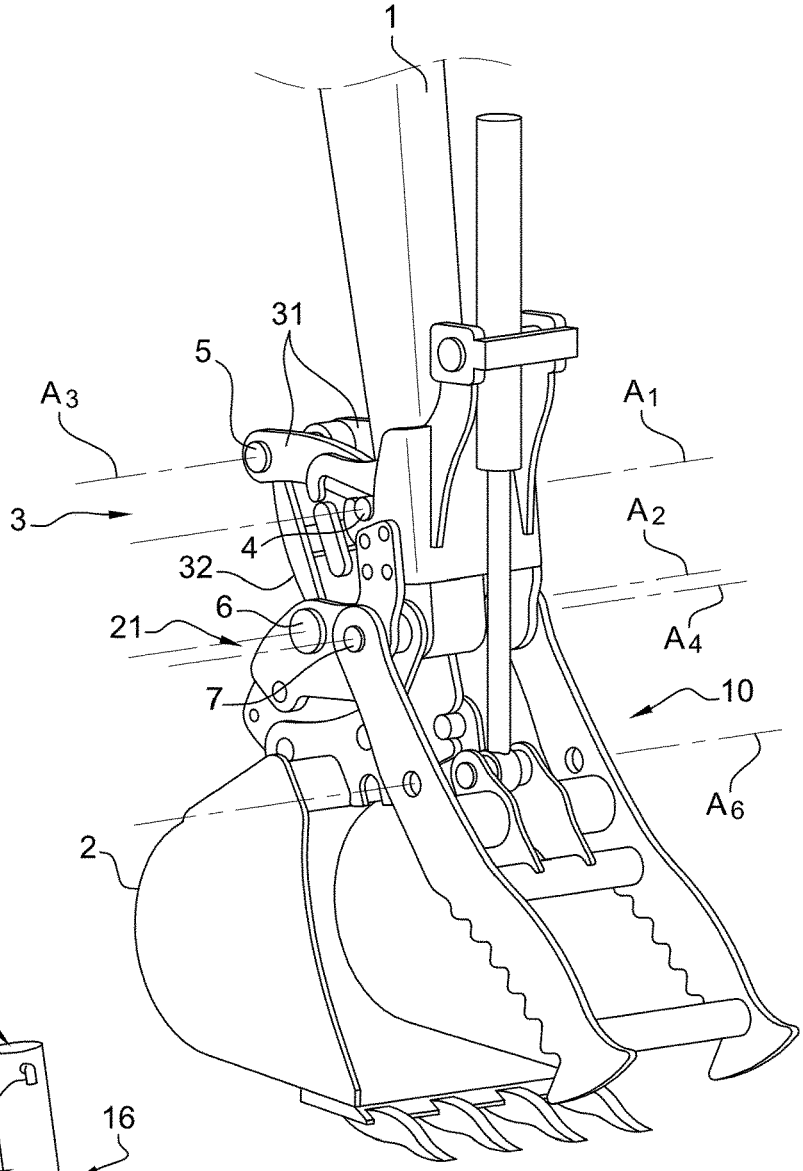
FIG. 1 is a fragmentary perspective view of a dipper arm of a backhoe digging apparatus equipped with a bucket and of a detachable thumb assembly according to the invention, the thumb assembly being attached to the dipper arm.

The following description is merely exemplary in nature and is not intended to limit the present disclosure, application, or uses. It should be understood that throughout the drawings, corresponding reference numerals indicate like or corresponding parts or features.

The present disclosure provides a detachable thumb assembly for a backhoe digging apparatus of a construction equipment machine.

It should be understood that the detachable thumb assembly as described herein is defined by a front orientation and a rear orientation, wherein the term "front" means "toward a front end of the machine" and the term "rear" means "toward a rear end of the machine".

In reference to FIG. 1, there is shown a detachable thumb assembly 10 according to an exemplary embodiment of the invention, when attached to a dipper arm 1 of a backhoe digging apparatus of a construction machine, in the present case a backhoe machine (not illustrated). Such a construction machine generally comprises a chassis mounted on four wheels or tracks and a cabin mounted on the chassis for receiving an operator of the machine, thus exhibiting the main looks of an agricultural tractor. Such a construction machine has been illustrated for example in FIG. 1 of EP 2 596 179. As seen in FIG. 1, an excavator bucket 2 is connected to the dipper arm 1 via a fastening pin 8 (illustrated in FIG. 3) and is articulated via a link mechanism 3 comprising two mutually articulated pairs of link levers 31, 32. A first pair of link levers 31 is pivotally connected to the dipper arm 1 by a first extremity around an axis A1, which is materialized by a fastening pin 4. A second pair of link levers 32 is pivotally connected to a pair of spaced apart mounting plates 21 of the bucket 2 by a first extremity around an axis A2, which is materialized by a fastening pin 6. The two pairs of link levers 31, 32 are mutually articulated by their second extremities around an axis A3 which is materialized by a fastening pin 5. The mounting plates 21 are articulated to the dipper arm 1 around an axis A4, thanks to a fastening pin 8 (see FIG. 3). The axes A1, A2, A3 and A4 are substantially parallel to each other. As detailed in the following paragraphs, the detachable thumb assembly 10 may be attached to or detached from the dipper arm 1 equipped with the bucket 2 via the fastening pins 4 and 8.

Figure 2:
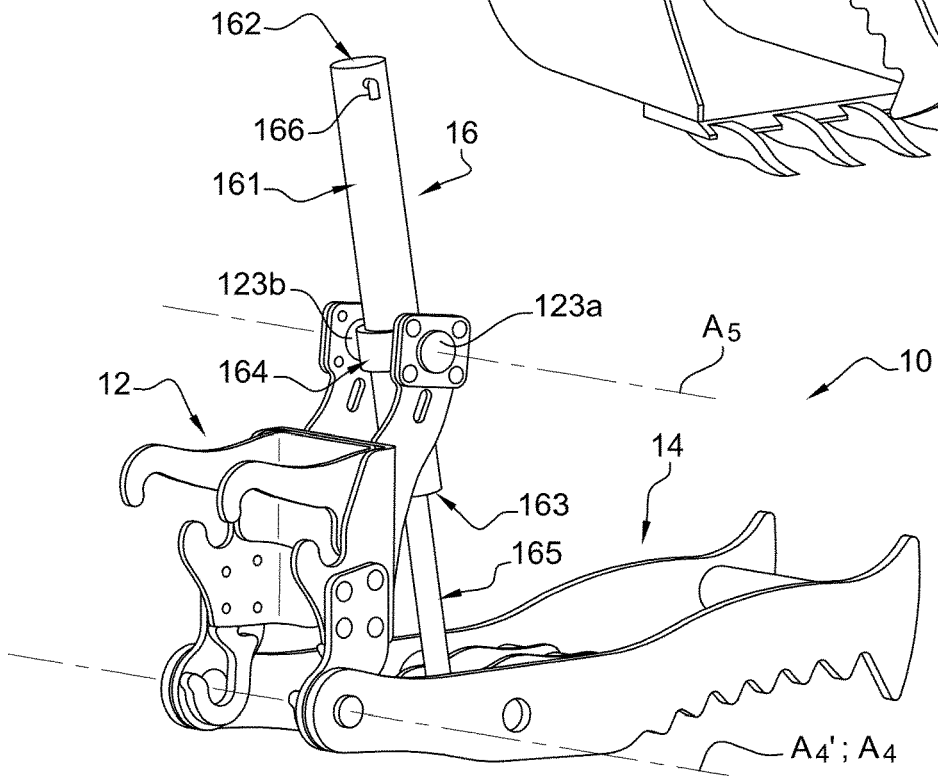
FIG. 2 is a perspective view of the detachable thumb assembly illustrated in FIG. 1.

In reference to FIG. 2, there is shown the detachable thumb assembly 10 illustrated in FIG. 1, when detached from the dipper arm 1 and the bucket 2. The thumb assembly 10 comprises:

- an attachment bracket 12 for attaching the thumb assembly 10 to the dipper arm 1;
- a thumb 14, which is pivotally connected to the attachment bracket 12 around an axis A4;
- a thumb cylinder 16 which extends between the attachment bracket 12 and the thumb 14 to control the angular position of the thumb 14 with respect to the dipper arm 1 during a work operation. The thumb cylinder 16 comprises a cylinder body 161, extending between a back end 162 and a front end 163, and a cylinder rod 165, which extends from the front end 163 of the cylinder body 161 and which is pivotally connected to the thumb 14 around a pivot axis A6 (see FIG. 1). The cylinder body 161 is pivotally connected to the attachment bracket 12 at a connection portion 164 through a pair of cylinder supports 123*a*, 123*b*, which define a pivot axis A5. In the embodiment shown, this pivot axis A5 is perpendicular to, and intersects, the longitudinal axis of the thumb cylinder 16, although both axes could also be offset. The back end 162 of the cylinder body 161 may comprise connecting means 166 for hydraulically connecting the thumb cylinder 16 to a hydraulic circuit of the machine which is preferably configured so as to allow the user of the machine to control the extension and retraction of the thumb 14 from the machine's operating station.

Conventionally, an attachment bracket can be attached to a dipper arm in various manners. While the attachment bracket could be mounted on dedicated attaching location provided on the dipper arm 1, according to the invention, it appears to be advantageous to provide that the attachment bracket 12 is attached to the dipper arm 1 by engaging the fastening pins 4 and 8 mentioned above.

Figure 3:
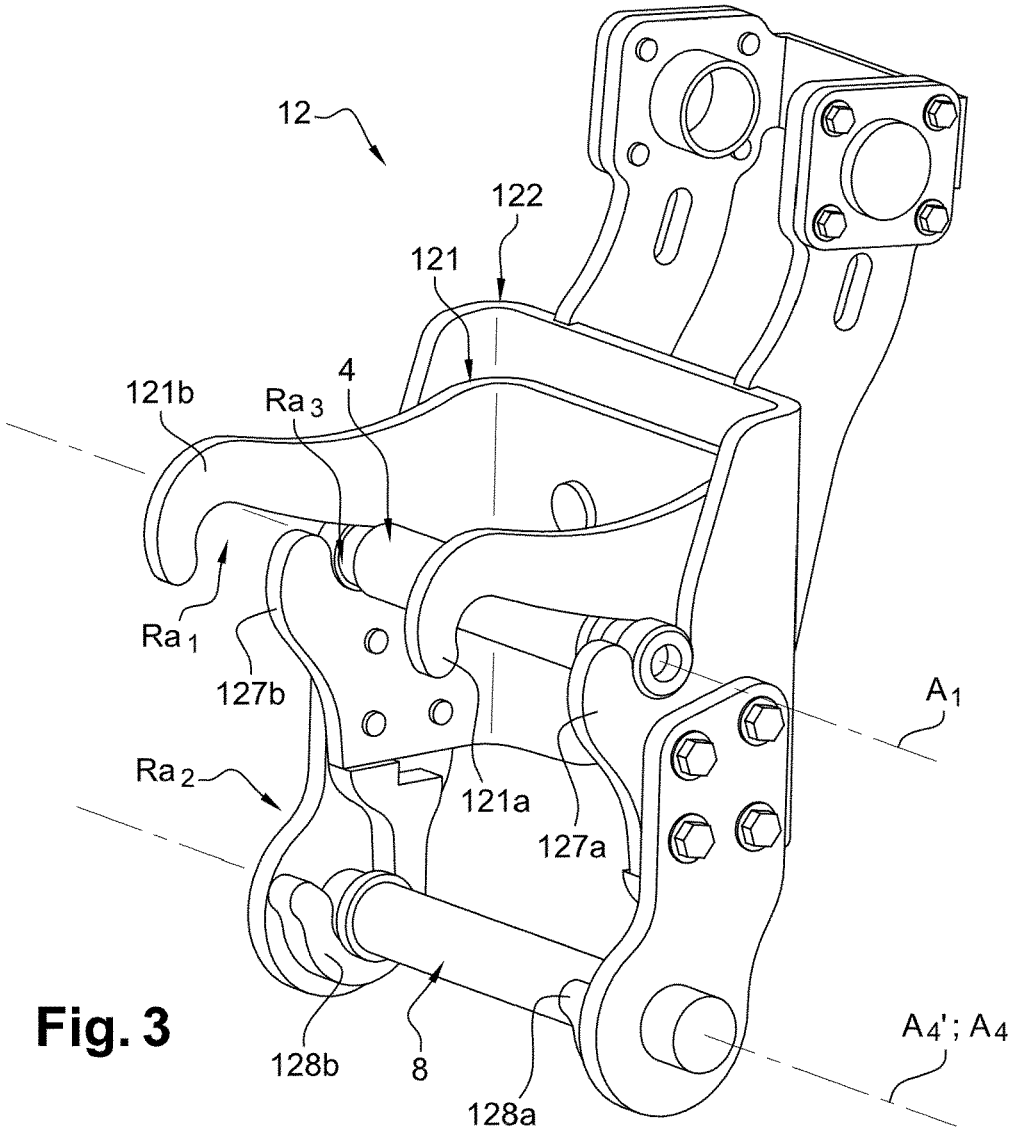
FIG. 3 is a front perspective view of the attachment mechanism equipping the detachable thumb assembly illustrated in FIG. 2.
Figure 5A:
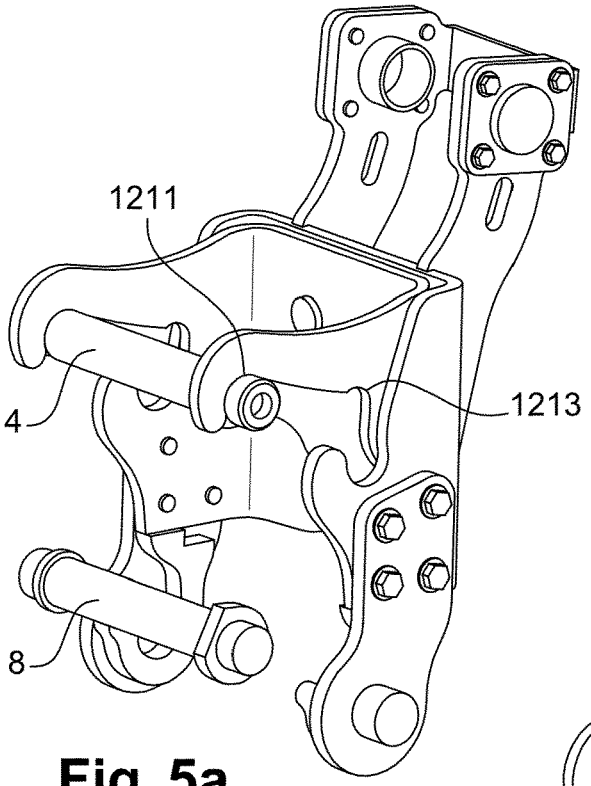
FIGS. 5*a*-5*c* are views similar to FIG. 3, in three successive attaching positions of the attachment mechanism respectively.
Figure 5B:
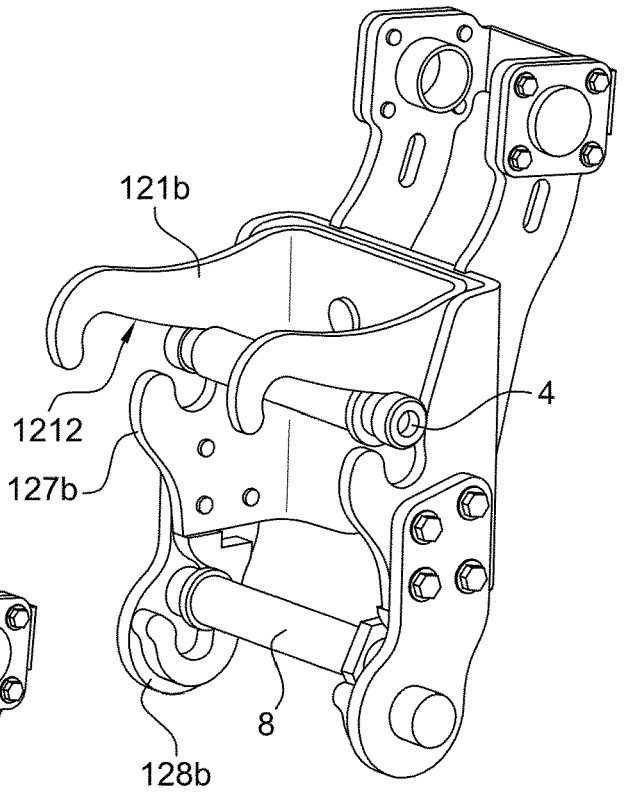
Figure 5C:
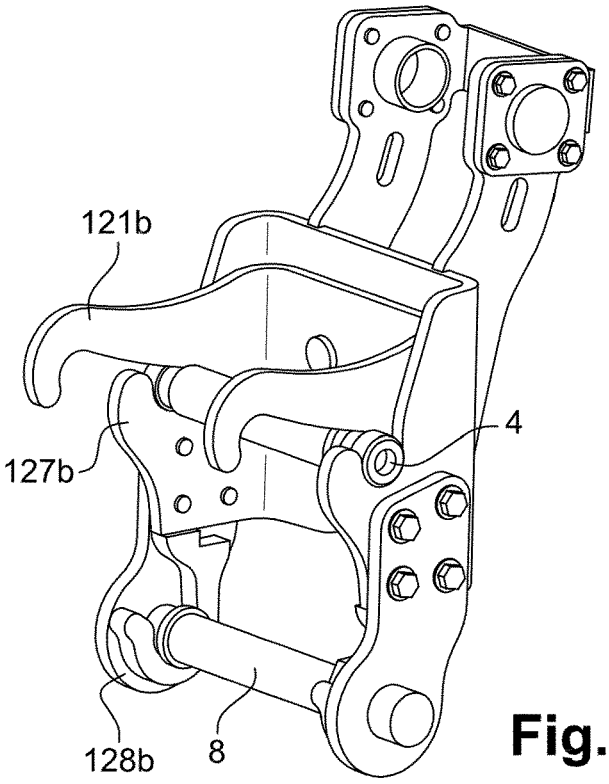

In reference to FIG. 3, there is a shown the attachment bracket 12 in a securely attached position relative to the fastening pins 4 and 8. In said attached position, the fastening pin 4 is respectively trapped or tightly retained in first receiving areas Ra1 and received in third receiving areas Ra3 of the attachment bracket 12 and the fastening pin 8 is received in second receiving areas Ra2 of the attachment bracket 12. In the context of the invention, the term "trapped" or "tightly retained" means that the fastening pin 4 cannot move in a radial direction relative to its axial direction A1. This specific position of the attachment bracket 12 corresponds to one of the possible positions of the attachment bracket 12, as illustrated in FIGS. 5*a* to 5*c*. The attachment bracket 12 may thus be positioned in the position shown in FIG. 5*c*, corresponding to the one of FIG. 3, but also in at least two further positions, respectively a first detached position illustrated in FIG. 5*a* and a second detached position illustrated in FIG. 5*b*, in which the fastening pin 4 is not tightly retained in the first receiving areas Ra1, and thus can be removed from said receiving areas Ra1, and in which the fastening pin 8 is not received in the second receiving areas Ra2. As better explained in the following paragraphs, the transfer of the position shown in FIG. 5*a* to the position shown in FIG. 5*b* may advantageously result of a pivoting movement of the dipper arm 1 and the transfer of the position shown in FIG. 5*b* to the position shown in FIG. 5*c* may advantageously result of a manual actuation of driving means.

Figure 4A:
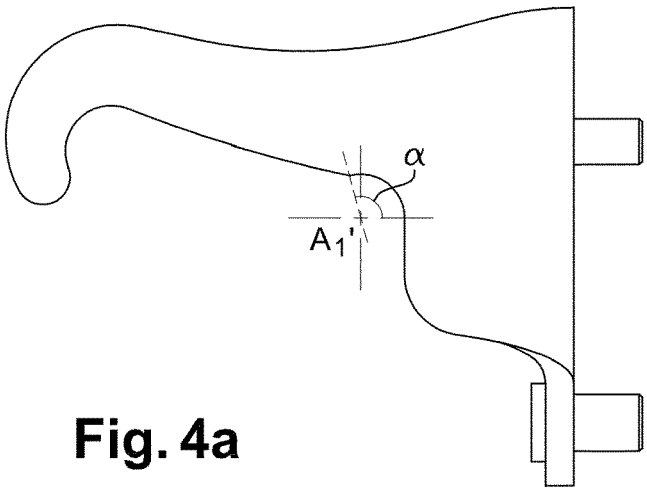
FIG. 4*a* is a side view of a first attachment element of the attachment mechanism illustrated in FIG. 3.
Figure 4:
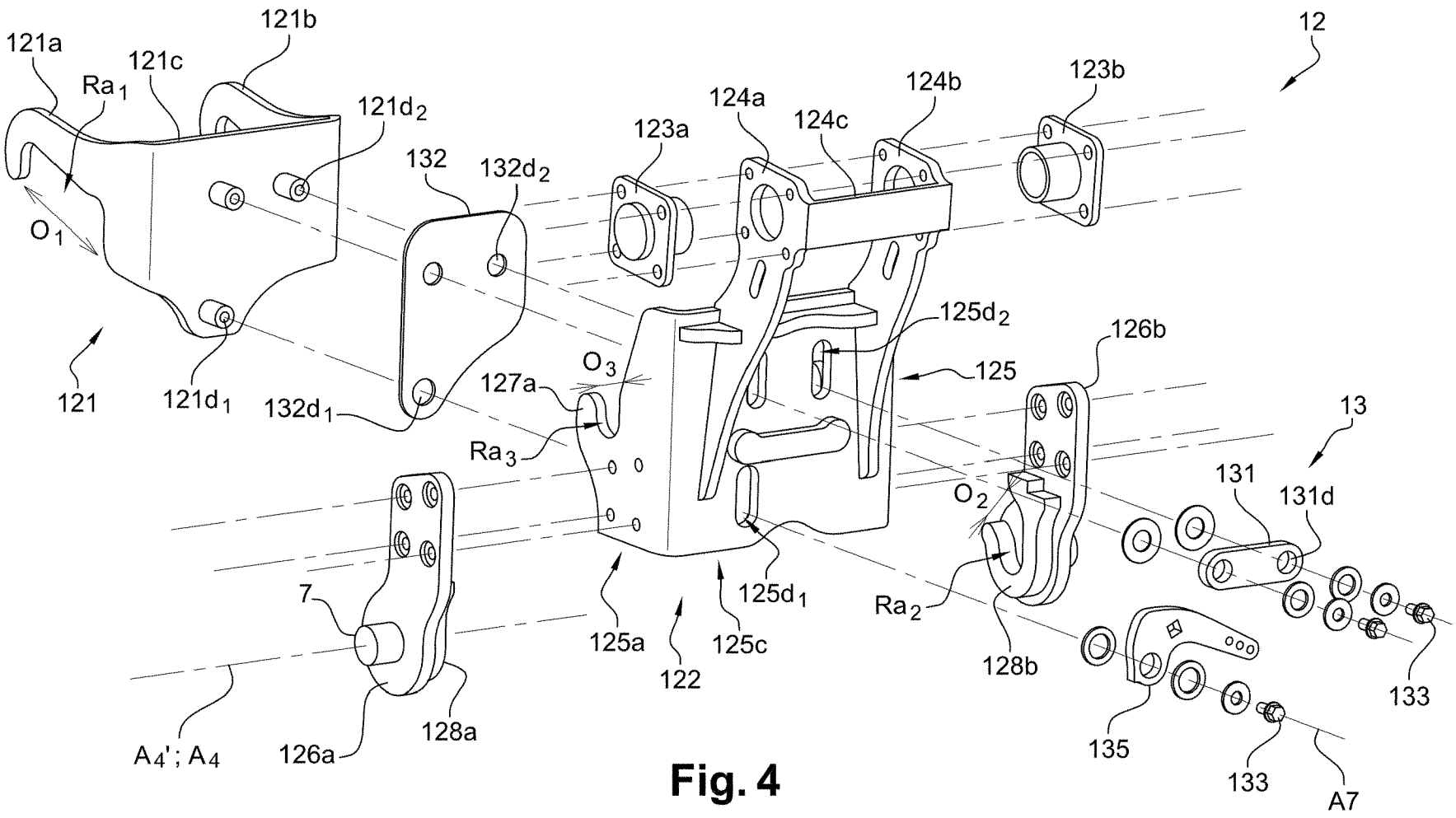
FIG. 4 is an exploded rear view of the attachment mechanism illustrated in FIG. 3.

In reference to FIG. 4, there is shown each constituent element of the attachment bracket 12. In particular, the attachment bracket 12 comprises a first attachment element 121 and a second attachment element 122, the attachment elements 121, 122 being slidably connected to each other, so as to be movable in translation between the position illustrated in FIG. 5*b* and the position illustrated in FIG. 5*c*. The first attachment element 121 has substantially a U-shape and comprises two parallel flanges 121*a*, 121*b* connected by a bottom plate 121*c*. Each flange 121*a*, 121*b* defines a C-shaped portion of the first attachment element 121, said C-shaped portion comprising a first end 1211, a second end 1213, and a linking surface 1212 joining said first end 1211 to said second end 1213, as shown in FIGS. 5*a*, 5*b*. The free space separating the first end 1211 and the second end 1213 defines the first receiving area Ra1 of the attachment bracket 12, said first receiving area Ra1 being adapted to receive the fastening pin 4. This C-shaped portion is defined by an opening O1 through which can be inserted the fastening pin 4 into the first receiving area Ra1. The first end 1211 and the second end 1213 may advantageously be curve shaped, the curvature of said first and second ends 1211, 1213 being substantially identical to the curvature of the fastening pin 4. Furthermore, the second end 1213 may advantageously be dimensioned to retain the fastening pin 4 in a locked position when the attachment bracket 12 is in the position illustrated in FIG. 5*b*. In particular, as illustrated in FIG. 4*a*, the second end 1213 may advantageously define an arc around a virtual axis A1', that is aligned with the axis A1 when the attachment bracket 12 is in the position illustrated in FIG. 5*b*, the arc defining an angle $\alpha$ which is greater than 90°, and preferably greater than 120°. In an alternative embodiment of the present invention, the first and second ends 1211, 1213 may be close to each other, no linking surface 1212 being provided between said first and second ends 1211, 1213. The opening O1 is oriented toward a corresponding C-shaped portion of the second attachment element 122. As illustrated in FIG. 4, this corresponding C-shape portion defines a substantially hemi-circular cutout in a laterally oriented flange 125*a* or 125*b* of a substantially U-shaped portion 125 of the second attachment element 122, the two flanges 125*a*, 125*b* of said portion 125 being connected by a bottom plate 125*c*. This substantially hemi-circular cavity defines a third receiving area Ra3 of the attachment bracket 12, said third receiving area Ra3 being adapted to receive the fastening pin 4 and being bordered by an opening O3 through which can be inserted the fastening pin 4 and by two extensions 127*a* and 127*b* projecting upwardly from the flanges 125*a*, 125*b*. As illustrated in FIG. 3, the openings O1 and O3 are oriented toward each other. The extensions 127*a*, 127*b* prevent that the fastening pin 4 moves out from the first receiving areas Ra1. However, said extensions 127*a*, 127*b* are not mandatory to retain the fastening pin 4 in the first receiving areas Ra1. In an alternative embodiment of the present invention, the attachment bracket 12 may thus be provided with only the first and second receiving areas Ra1 and Ra2, and not the third receiving areas Ra3.

The second attachment element 122 further comprises a pair of extension plates 126*a* and 126*b* fixedly connected to the lateral flanges 125*a* and 125*b* respectively through fixation screws, each extension plate 126*a*, 126*b* having an internal side, that is oriented toward the corresponding flange 125*a*, 125*b*, and an external side, that is opposite to the internal side. Each extension plate 126*a*, 126*b* comprises a cylindrical lug 7 protruding from the external side thereof, said lug 7 being adapted to cooperate with a corresponding through-hole of the thumb 14 to pivotally connect said thumb 14 around a pivot axis A4', which may advantageously correspond to the pivot axis A4 (see FIG. 2). A C-shaped portion 128*a*, respectively 128*b*, protrudes from the internal side of the extension plate 126*a*, respectively 126*b*, said C-shaped portions 128*a*, 128*b*, define the second receiving areas Ra2 of the attachment bracket 12, said second receiving areas Ra2 being adapted to receive the fastening pin 8 and being bordered by an opening O2 through which can be inserted the fastening pin 8. As illustrated in FIG. 3, the openings O1 and O2 are oriented toward each other. The second attachment element 122 further comprises a pair of back struts 124*a*, 124*b* integral with the U-shaped portion 125 and extending upward and rearward from the bottom plate 125*c*. The back struts 124*a*, 124*b* are connected together at their upper end through a cross-strut 124*c*. Said upper ends are adapted to fixedly connect the pair of cylinder supports 123*a*, 123*b*.

In the embodiment shown in FIG. 3, the relative movement between the first and second attachment elements 121 and 122 results from specific features of said first and second attachment elements 121 and 122 and by the actuation of driving means adapted to cooperate with said specific features to move the second attachment element 122 from the position illustrated in FIG. 5*b* to the position illustrated in FIG. 5*c* and vice versa. These driving means may be chosen among an endless screw, a gearing, a rack and pinion, a cam, a pneumatic or hydraulic actuator in fluid connection with the pneumatic or hydraulic circuit of the construction equipment machine. In the embodiment illustrated in FIGS. 4 and 6*a* to 6*c*, said driving means comprise a L-shaped locking cam 135 pivotally connected to the first attachment element 121 around an axis A7 though a bolt 133 threadedly connected to a first lug 121*d*1 protruding at the rear side of the bottom plate 121*c*. In other words, the first lug 121*d*1 protrudes on a side of the bottom plate 121*c* that is opposite to the flanges 121*a* and 121*b*. Said cam 135 is separated from said bottom plate 121*c* by successively the bottom plate 125*c* and an optional intermediate plate 132 that is preferably realized in a material having a low friction coefficient to ease sliding motions between the first attachment element 121 and the second attachment element 122. When considering the attachment mechanism as one assembly, the locking cam 135 is located on a side of the bottom plates 121*c*, 125*c* that is opposite to the flanges 121*a*, 121*b*, 125*a*, 125*b*. To permit the connection of the locking cam 135 to the first attachment element 121, the bottom plate 125*c* and the intermediate plate 132 are respectively provided with a vertically oriented through slot 125*d*1 and a through-hole 132*d*1. In addition, the first attachment element 121 is fixedly connected to a guiding element 131 having two rounded ends joined by a straight section, each rounding end being provided with a through-hole 131*d*. The guiding element 131 is positioned at the rear side of the bottom plate 125*c* and is separated from the bottom plate 121*c* by successively the bottom plate 125*c* and the intermediate plate 132. The first attachment element 121 is advantageously provided with a pair of second lugs 121*d*2 protruding from the rear side of the bottom plate 121*c*, the second lugs 121*d*2 being adapted to be threadly connected to a pair of bolts 133, which are successively received in the pair of through-holes 131*d* of the guiding element 131, a pair of vertically oriented through slots 125*d*2 provided in the bottom plate 125*c* of the second attachment element 122 and a pair of through-holes 132*d*2 provided in the intermediate plate 132.

Figure 6A:
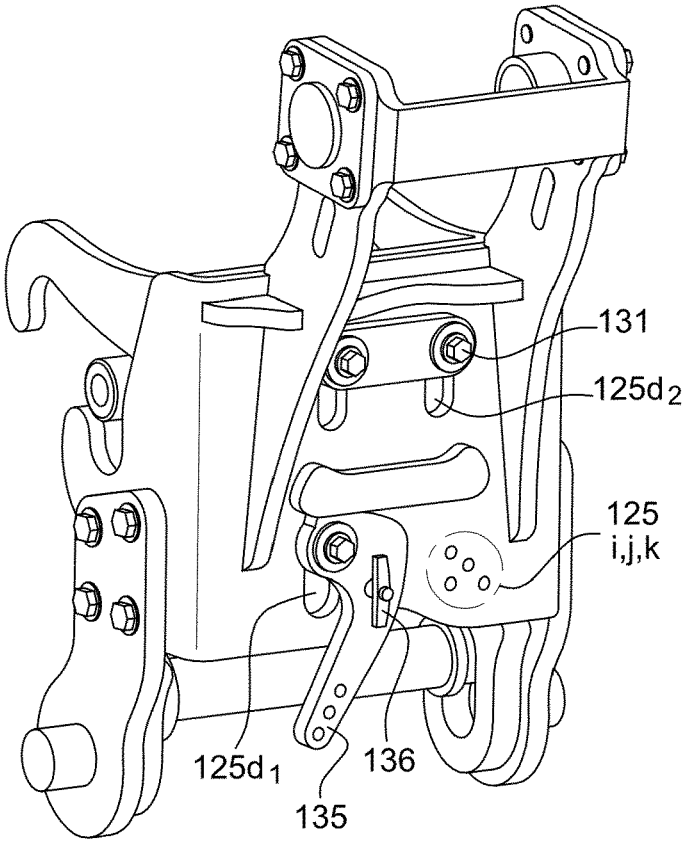
FIG. 6*a* is a rear perspective view of the attachment mechanism in the position illustrated in FIG. 5*b*.
Figure 7:
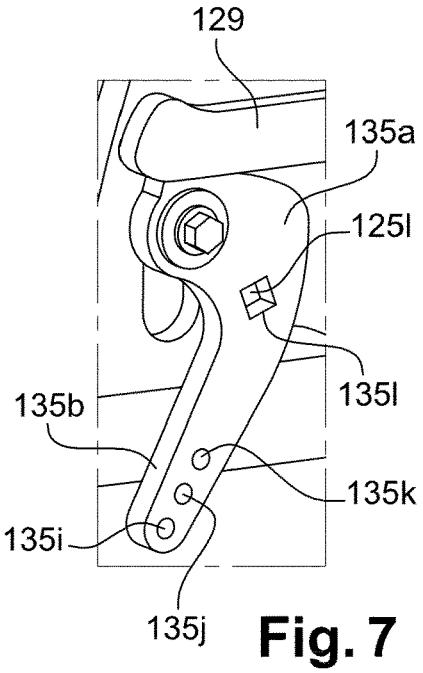
FIG. 7 is an enlarged view of a detail of FIG. 6*a*.
Figure 8:
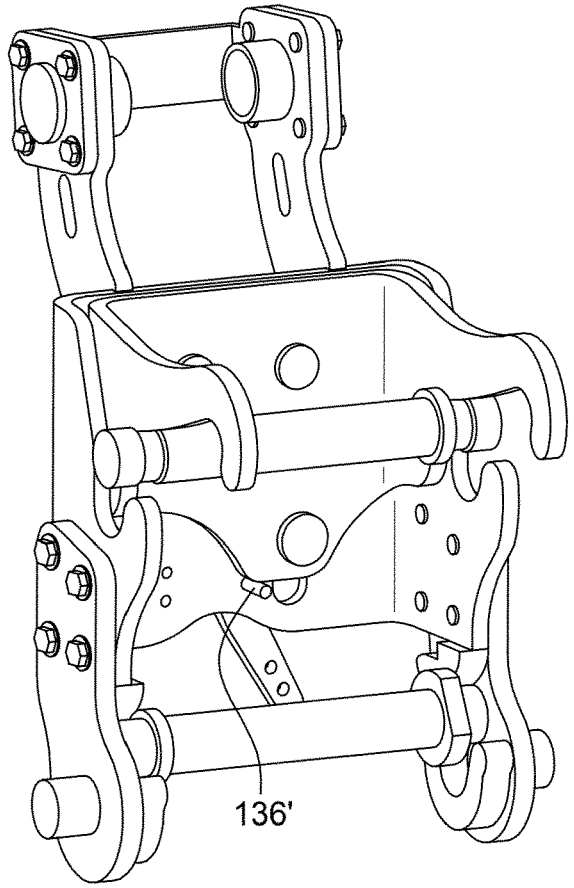
FIG. 8 is a front perspective view of the attachment mechanism illustrated in FIG. 6*a*.

In reference to FIGS. 6*a*, 7 and 8, there is shown the attachment bracket 12 when opened in the position illustrated in FIG. 5*b*. In this position, the guiding element 131 faces a top part of the through slots 125*d*2 and a rounded end 135*a* of the cam 135 faces a top part of the through slot 125*d*1. The rounded end 135*a* is in contact with an abutment element 129 protruding from the rear side of the bottom plate 125*c* and integral therewith. A square-shaped through-hole 135*l* provided in an intermediate section of the cam 135 between the rounded end 135*a* and an elongate end 135*b* thereof is aligned with a corresponding through-hole 125*l* provided in the bottom plate 125*c*, thus permitting the insertion of a locking pin 136' through said through-holes 125*l* and 135*l* which prevents a movement of the cam 135 relative to the first attachment element 121. The locking pin 136' may advantageously be configured to protrude from the front side of the bottom plate 125*c*, thus defining an abutment against which abuts the first attachment element 121 in the position shown in FIG. 6*a* which prevents a relative movement between the first and second attachment elements 121, 122. The locking pin 136' may advantageously be fixedly connected to a lug 136 protruding from the rear side of the cam 135, thus permitting to a user to easily introduce or remove the locking pin 136' from the though-holes 125*l* and 135*l*.

Figure 6B:
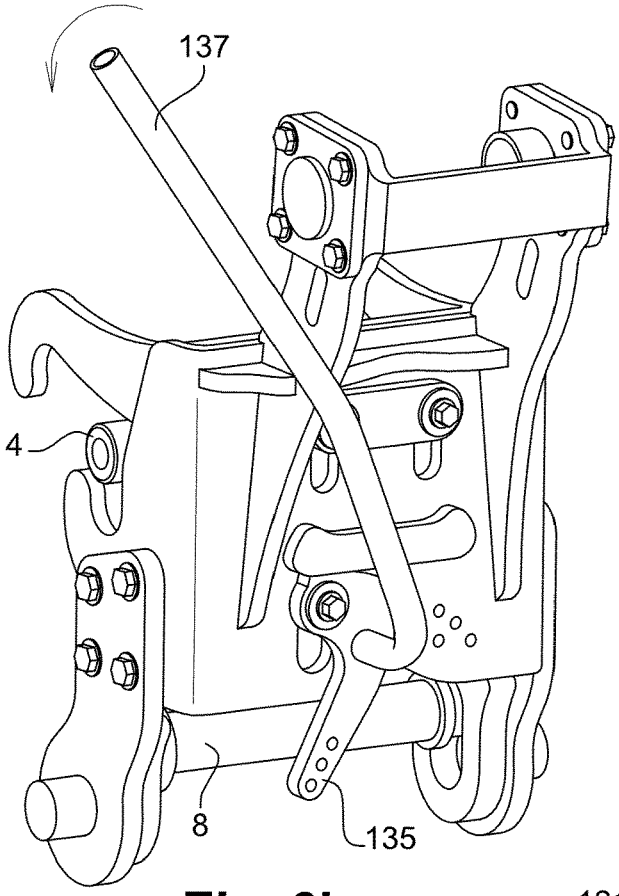
FIG. 6*b* is a view similar to FIG. 6*a*, but in an intermediate position between the position illustrated in FIG. 5*b* and the position illustrated in FIG. 5*c*.

In reference to FIG. 6*b*, there is shown the attachment bracket 12 just after it is unlocked from the position illustrated in FIG. 5*b* and just before its transfer to the position illustrated in FIG. 5*c*. In this position, the locking pin 136' has been removed from the through-holes 125*l* and 135*l* and a square-shaped end (not shown) of a lever 137 has been introduced in the through-hole 135*l*. Thus, a user can act on the lever 137 to generate a counterclockwise rotation of the cam 135 around the axis A7. This rotating movement of the cam 135 will lead the rounded end 135*a* to push on the abutment element 129 of the second attachment element 122, which will result in an upward movement of said second attachment element 122 relative to the first attachment element 121.

Figure 6C:
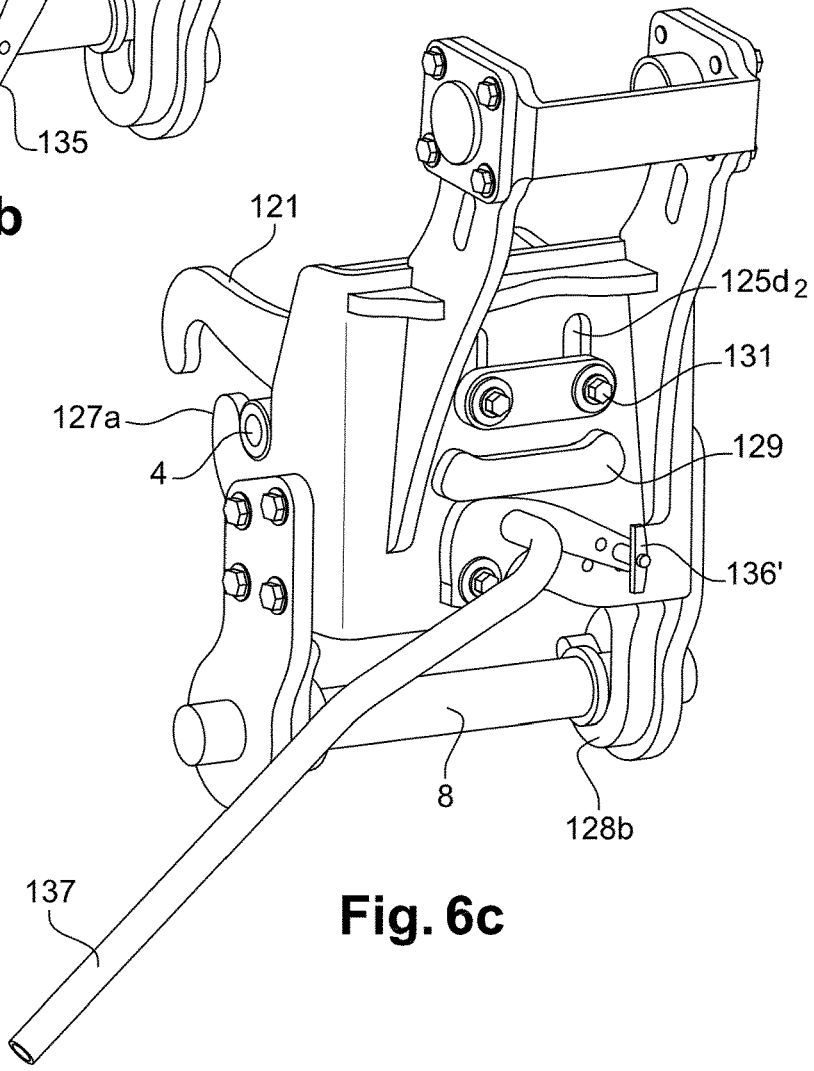
FIG. 6*c* is a view similar to FIG. 6*a*, but in the position illustrated in FIG. 5*c*.

In reference to FIG. 6*c*, there is shown the attachment bracket 12 just after it is transferred to the position illustrated in FIG. 5*c* and it is locked in said position. In this position, the lever 137 and the cam 135 are substantially perpendicular to their previous position shown in FIG. 6*b*. The guiding element 131 faces a bottom part of the through slots 125*d*2 and the rounded end 135*a* of the cam 135 faces both the bottom part and the top part of the through slot 125*d*1. To prevent the cam 135 to move relative to the first attachment element 121, a locking pin 136' has been introduced in one of a series of through-holes 135*i-k* provided in the elongate end 135*b* of the cam 135 (see FIG. 7) and in one of a corresponding series of through-holes 125*i-k* provided in the bottom plate 125*c* (see FIG. 6*a*). The two series of through-holes 125*i-k* and 135*i-k* may advantageously permit to find the best locking position of the cam 135 that could firmly and safely trap the fastening pins 4 and 8 in the receiving areas Ra1 Ra2 and Ra3.

In reference to FIGS. 9*a* to 9*e*, there is shown the successive steps permitting the attachment of a thumb assembly 10 according to the invention to a dipper arm 1 provided with first and second fastening pins 4 and 8.

Figure 9A:
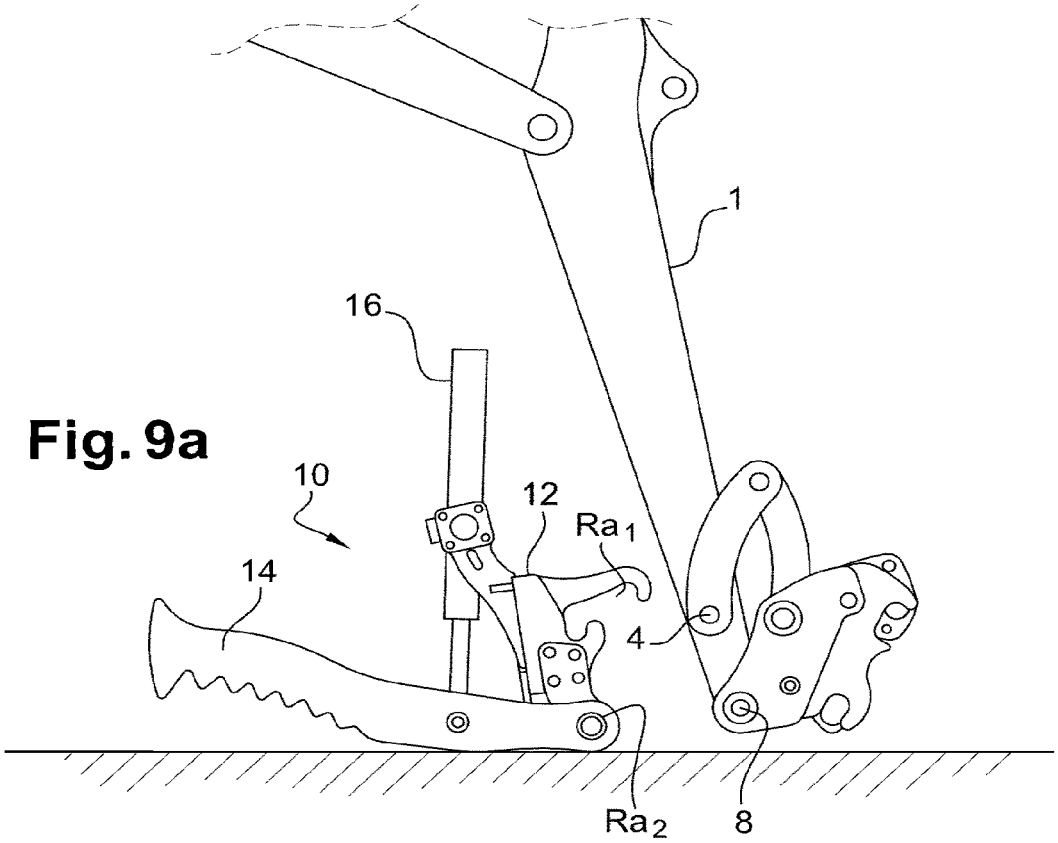
FIG. 9*a*-9*e* are fragmentary side views of the dipper arm and of the detachable thumb assembly illustrated in FIG. 1, in respectively five successive attaching steps of the method according to the invention.

In a first step illustrated in FIG. 9*a*, the dipper arm 1 is moved toward the thumb assembly 10 that is lying on the ground in a storage position. In this storage position, the thumb 14 is substantially perpendicular to the cylinder 16. The attachment bracket 12 is in the position illustrated in FIG. 5*b*, wherein the second attachment element 122 has been moved with respect to the first attachment element 121 such that the distance between the receiving areas Ra1 and Ra2 is the greatest possible.

Figure 9B:
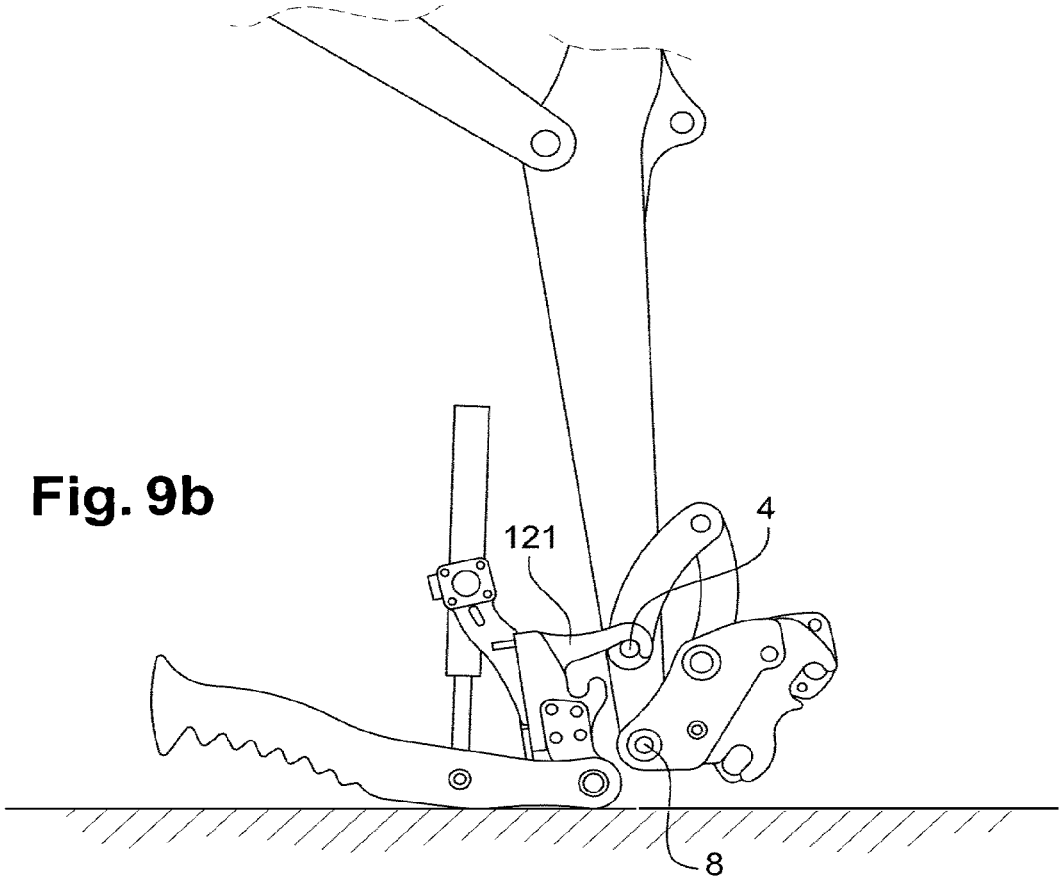

In a second step illustrated in FIG. 9*b*, the dipper arm 1 is moved to position the first fastening pin 4 inside the receiving areas Ra1 in an initial position in which said first fastening pin 4 abuts against the first ends 1211 of the C-shaped portions of the first attachment element 121.

Figure 9C:
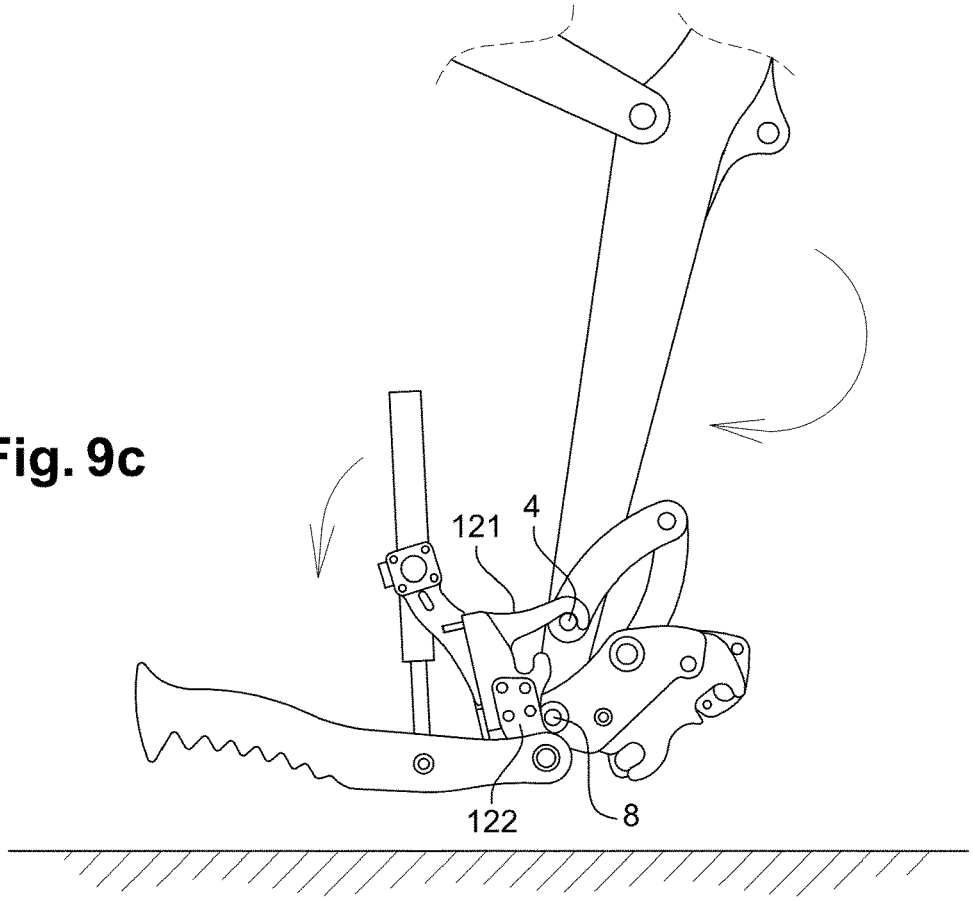

In a third step illustrated in FIG. 9*c*, the dipper arm 1 pivots around an articulation axis (not shown) such that the tool assembly 10, that is temporalily connected to the dipper arm 1 via the first fastening pin 4, pivots relative to the dipper arm 1 about said fastening pin 4 till the second attachment element 122 abuts against the second fastening pin 8.

Figure 9D:
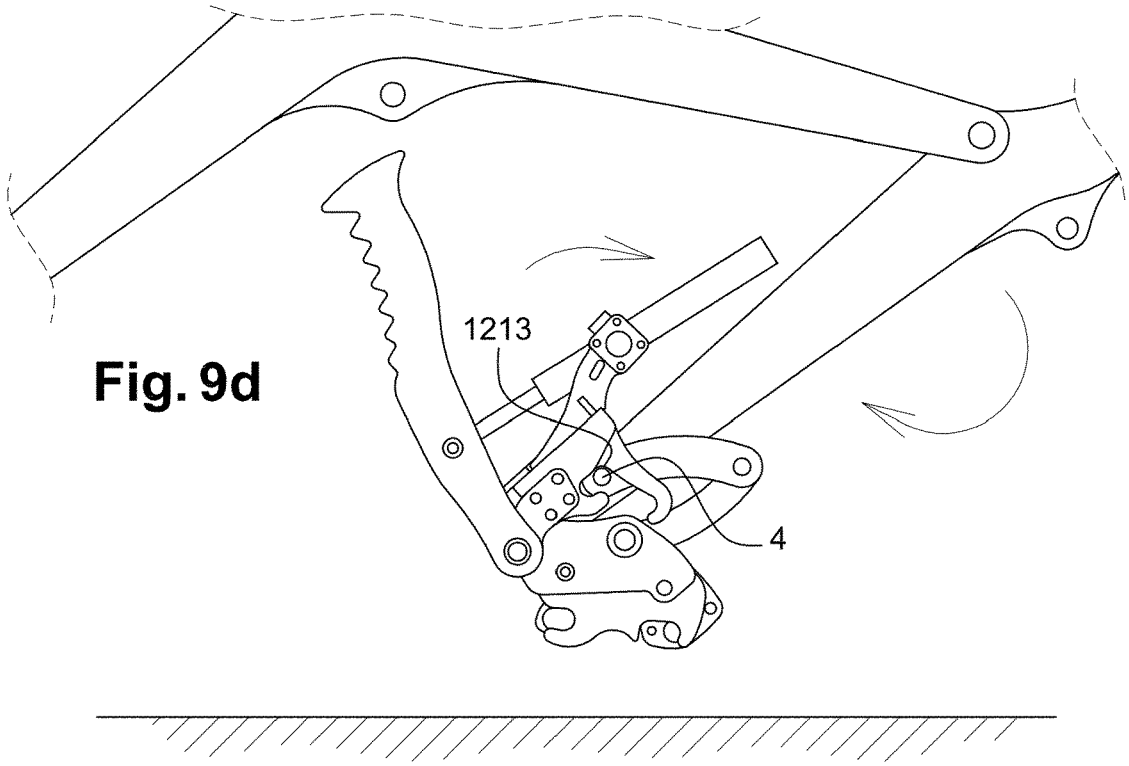

In a fourth step illustrated in FIG. 9*d*, the dipper arm 1 further pivots around the articulation axis such that the first fastening pin 4 moves along the linking surfaces 1212 of the C-shaped portions of the first attachment element 121 and reaches a final position in the first receiving areas Ra1, in which it abuts against the second ends 1213 of said C-portions. At this end of this step, the attachment bracket 12 is in the position illustrated in FIG. 5*b*.

Figure 9E:
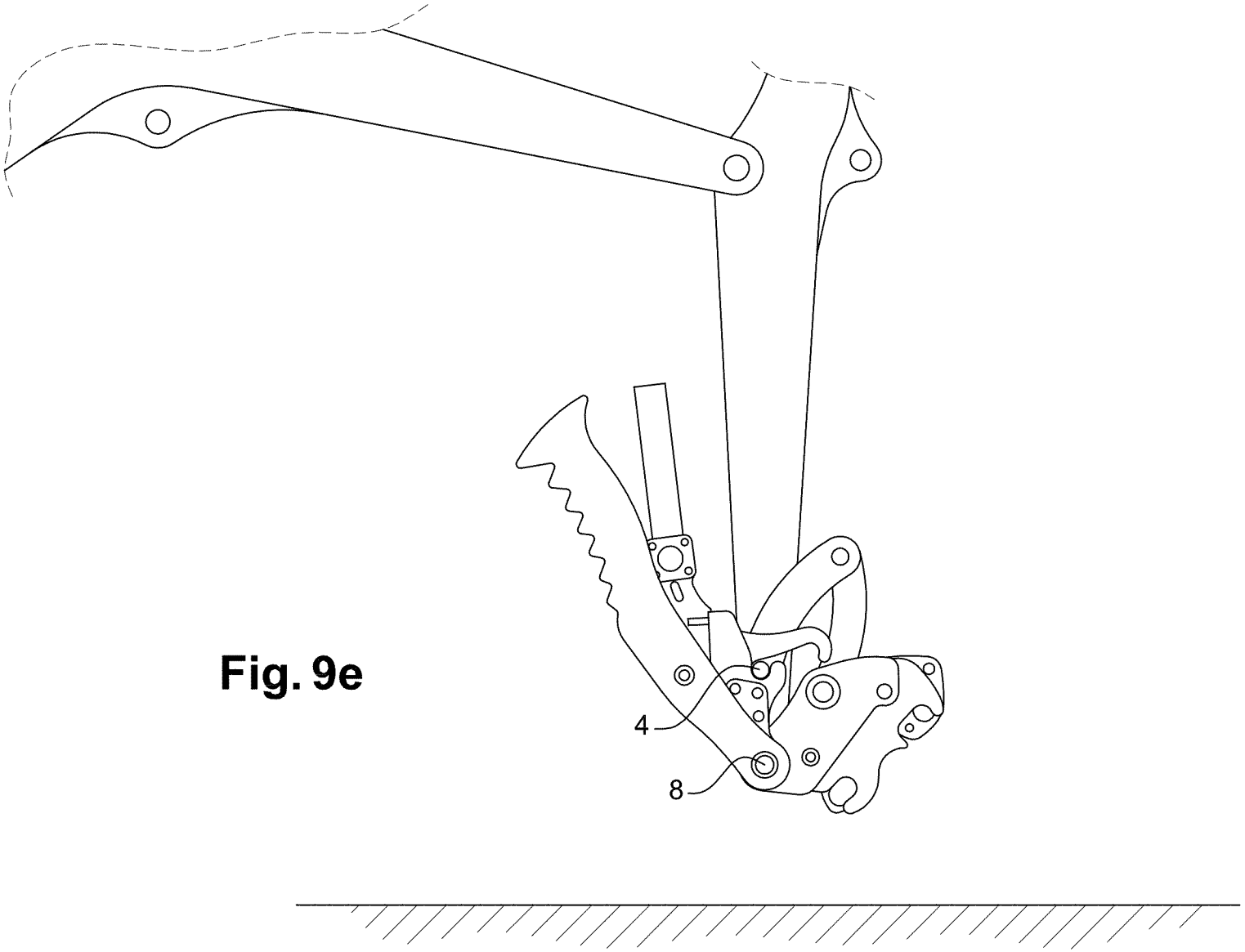

In a final step illustrated in FIG. 9*e*, a user manually actuates the cam 135, as illustrated in FIGS. 6*a*-6*c*, to transfer the attachment bracket 12 in the position illustrated in FIG. 5*c* and locks this position with the locking pin 136'. Thereafter, the thumb cylinder 16 is hydraulically connected to a hydraulic circuit of the machine and the thumb 14 is retracted in a storage position through said thumb cylinder 16.

Figure 10A:
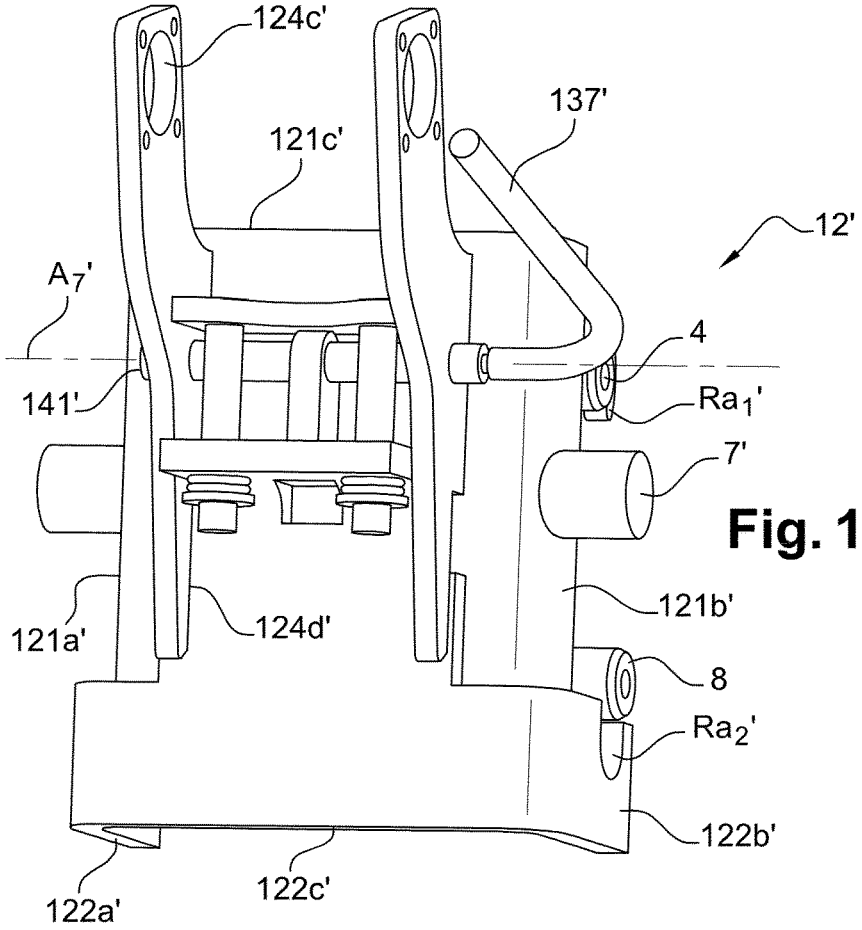
FIGS. 10*a* and 10*b* are views similar to FIGS. 6*b* and 6*c* in an alternative embodiment of the attachment mechanism.
Figure 10B:
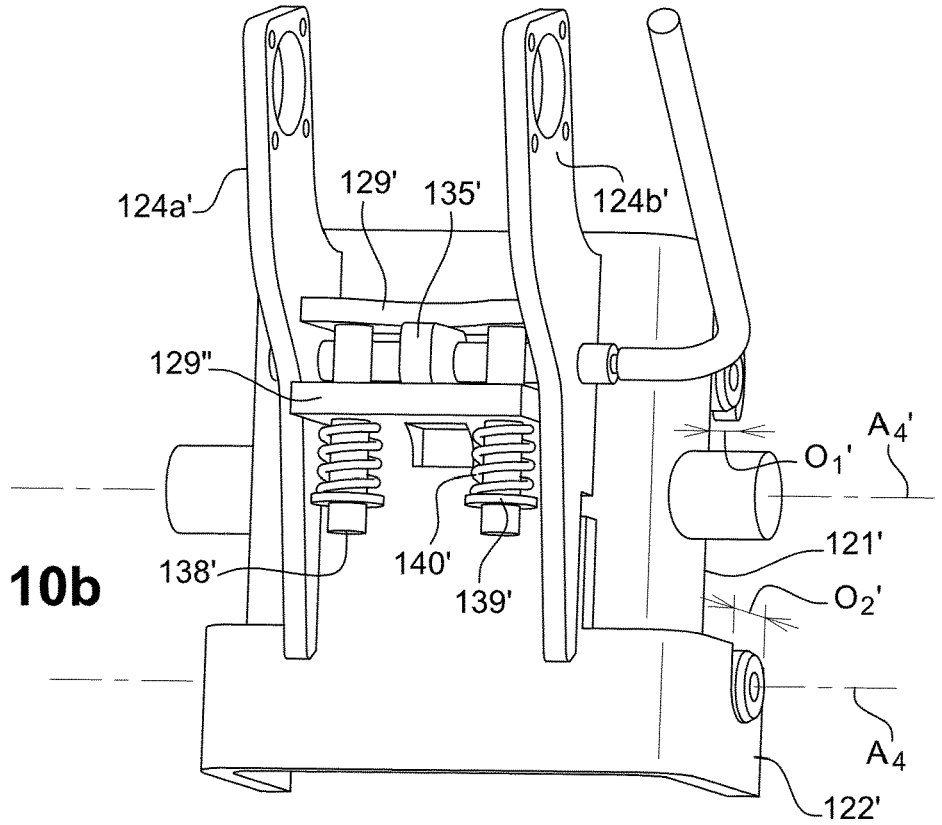

In reference to FIGS. 10*a* and 10*b*, there is shown an alternative attachment bracket 12' that may be used to attach the removable tool assembly 10 to the dipper arm 1. This bracket 12' comprises a first attachment element 121' having a first receiving areas Ra1' adapted to receive the fastening pin 4 and a second attachment element 122' having a second receiving areas Ra2' adapted to receive the fastening pin 8. The first and second attachment elements 121', 122' are slidably connected to each other, so as to be movable between the position illustrated in FIG. 10*a*, in which the fastening pins 4 and 8 can be removed from the first and second receiving areas Ra1', Ra2', and the position illustrated in FIG. 10*b*, in which the fastening pins 4 and 8 are tightly retained in the first and second receiving areas Ra1', Ra2'. The first attachment element 121' comprises a substantially U-shaped portion defined by a pair of parallel flanges 121*a'*, 121*b'* connected by a bottom plate 121*c'*, and a pair of back struts 124*a'*, 124*b'* integral with said U-shaped portion and extending upward and rearward from the bottom plate 121*c'*. Each back strut 124*a'*, 124*b'* has an upper end 124*c'* that is adapted to fixedly connect a cylinder support (not illustrated) and a lower end 124*d'* that is adapted to partially receive the second attachment element 122'. Each flange 121*a'*, 121*b'* comprises a cylindrical lug 7' protruding from the external side thereof, said lug 7' being adapted to cooperate with a corresponding through-hole of the thumb 14 to pivotally connect said thumb 14 around a pivot axis A4' that is in this embodiment different from the pivot axis A4 defined by the fastening pin 8. In an alternative embodiment, the lugs 7' may be advantageously designed such that the pivot axis A4' is aligned with the pivot axis A4 defined by the fastening pin 8. Each flange 121*a'*, 121*b'* comprises a C-shaped portion at its upper end, said C-portions defining the first receiving areas Ra1'. The second attachment element 122' has a substantially U-shape and comprises two parallel flanges 122*a'*, 122*b'* connected by a bottom plate 122*c'*. Each flange 122*a'*, 122*b'* comprises a C-shaped portion at its upper end, said C-portions defining the second receiving areas Ra2'. The openings O1', O2', through which can be inserted the fastening pins 4 and 8 in the first and second receiving areas Ra1' and Ra2' respectively, are oriented toward each other. Furthermore, the attachment bracket 12' comprises a pair of abutment struts 129', 129", respectively an upper abutment strut 129' and a lower abutment strut 129", oriented perpendicular to the bottom plates 121*c'* and 122*c'*, the abutment strut 129' being integral with the bottom plate 121*c'* and the abutment strut 129" being integral with the bottom plate 122*c'*. These abutment struts 129', 129" are separated by a locking cam 135' having a substantially rectangular shape defined by a pair of short sides and a pair of long sides. In the position illustrated in FIG. 10*a*, the locking cam 135' is oriented so as to be contact with the abutment struts 129', 129" by its short sides and, in the position illustrated in FIG. 10*b*, the locking cam 135' is oriented so as to be contact with the abutment struts 129', 129" by its long sides. The movement of the locking cam 135' between these two positions occurs when a user manually acts on a lever 137' that can be temporarily pivotally connected to one end of a pivot axle 141' fixedly connected to the locking cam 135', said pivot axle 141' defining a pivot axis A7'. The lower abutment strut 129" is maintained in contact with the locking cam 135' through a pair of compression springs 140', each compression spring 140' being disposed around a vertically oriented cylindrical support 138', that is integral with the upper abutment strut 129', and having one upper end abutting against the lower abutment strut 129" and one lower end abutting against a shoulder 139' provided along the cylindrical support 138'.

The successive steps permitting the attachment of a thumb assembly 10 equipped with the attachment bracket 12' to a dipper arm 1 are relatively similar to those mentioned with regard to the embodiment illustrated in FIG. 2, apart that the steps illustrated in FIG. 9*d* does not occur for the attachment bracket 12', the fastening pin 4 being closely maintained in the receiving areas Ra1' Furthermore, in the final step, corresponding to the one illustrated in FIG. 9*e*, the attachment bracket 12' is not locked in the position illustrated in FIG. 10*b* through a locking pin, but through the compression springs 140' and the abutment struts 129', 129".

It is to be understood that the present invention is not limited to the embodiments described above and illustrated in the drawings; rather, the skilled person will recognize that many changes and modifications may be made within the scope of the appended claims.

The invention claimed is:

1. A removable tool assembly for a backhoe apparatus of a construction equipment machine having spaced apart parallel first and second fastening pins, said removable tool assembly comprising an attachment mechanism for releasably attaching said removable tool assembly onto the backhoe digging apparatus, the attachment mechanism comprising:

a first attachment element having first receiving areas (Ra1, Ra1') adapted to receive the first fastening pin, and a second attachment element having second receiving areas (Ra2, Ra2') adapted to receive the second fastening pin, wherein the second attachment element is movable relative to the first attachment element between a first position, in which the first and second fastening pins can be removed from the first and second receiving areas, and a second position, in which the first and/or second fastening pins are tightly retained in the first and/or second receiving areas, wherein the first and second receiving areas are closer in said second position than in said first position;

a driving means adapted to move the second attachment element from the first position thereof to the second position thereof and vice versa;

wherein the first receiving area and the second receiving area are defined by C-shaped portions of the first attachment element and the second attachment element, said C-shaped portions defining openings through which can be inserted the first fastening pin and the second fastening pin into the first receiving area and the second receiving area, wherein the openings respectively defined by the C-shaped portions of the first and second attachment elements are oriented toward each other; and wherein the second attachment element comprises third receiving areas adapted to receive the first fastening pin in the second position of the second attachment element.

2. The removable tool assembly according to claim 1, wherein the driving means comprise a spring structure resiliently biasing the second attachment element toward the second position thereof and a locking cam pivotally connected to the first attachment element and maintained in contact with the second attachment element by said spring structure, said locking cam being movable between an unlocking position, in which the second attachment element is in the first position thereof, and a locking position, in which the second attachment element is in the second position thereof.

3. The removable tool assembly according to claim 2, wherein the locking cam is integral with a pivot axle pivotally connected to the first attachment element, said pivot axle defining a pivot axis and being adapted to be temporarily connected to a lever, a pivoting movement of the lever around said pivot axis leading the locking cam to move from the locking position thereof to the unlocking position thereof or vice versa.

4. The removable tool assembly according to claim 1, wherein the third receiving areas are defined by C-shaped portions of the second attachment element, said C-shaped portions defining openings through which can be inserted the first fastening pin into the third receiving areas, said openings being oriented toward the openings defined by the C-shaped portions of the first attachment element.

5. The removable tool assembly according to claim 1, wherein each C-shaped portion of the first attachment element comprises a first end, against which abuts the first fastening pin in an initial position of the removable tool assembly, and a second end, against which abuts the first fastening pin in a final position of the removable tool assembly.

6. The removable tool assembly according to claim 5, wherein each C-shaped portion of the first attachment element comprises a linking surface joining the first end to the second end, said linking surface defining a guiding path for the first fastening pin during the transfer of the removable tool assembly from the initial position to the final position.

7. The removable tool assembly according to claim 1, wherein the driving means comprise a locking cam pivotally connected to the first attachment element and in contact with an abutment surface of the second attachment element, said locking cam being movable between an unlocking position, in which the second attachment element is in the first position thereof, and a locking position, in which the second attachment element is in the second position thereof.

8. The removable tool assembly according to claim 7, wherein the locking cam comprises at least one first through-hole, and preferably a series of first through holes, adapted to receive a locking pin in the locking position thereof, said first through-hole, or through holes, being aligned with a corresponding through-hole, or through-holes, formed inside the second attachment element in said locking position, a movement of the locking cam relative to the first attachment element being thus prevented when the locking pin is received in said first through-hole, or through-holes, and said corresponding through-hole, or through-holes.

9. The removable tool assembly according to claim 7, wherein the locking cam comprises at least one second through-hole adapted to receive a locking pin in the unlocking position thereof, said second through-hole being aligned with a corresponding through-hole formed inside the second attachment element in said unlocking position, a movement of the locking cam relative to the first attachment element being thus prevented when the locking pin is received in said second through-hole and said corresponding through-hole.

10. The removable tool assembly according to claim 7, wherein the locking cam comprises at least one third through-hole adapted to receive a mounting end of a lever, said lever permitting to a user to manually move the locking cam from the unlocking position thereof to the locking position thereof and vice versa when the mounting end is received in the third through-hole.

11. The removable tool assembly according to claim 1, wherein each of the first attachment element and the second attachment element comprises a U-shaped portion having two parallel flanges connected by a bottom plate, the U-shaped portions of the first and second attachment elements sliding one into the other.

12. The removable tool assembly according to claim 11, wherein the first and/or the second receiving areas are formed by cut-out portions of the flanges of the U-shaped portions and the driving means are part of and/or connected to the bottom plates of said U-shaped portions.

13. The removable tool assembly according to claim 12, wherein the driving means are at least partially located on a side of the bottom plates that is opposite to the flanges.

14. The removable tool assembly according to claim 13, wherein the driving means are the locking cam of claim 5, said locking cam being located on a side of the bottom plates that is opposite to the flanges.

15. The removable tool assembly according to claim 11, wherein the bottom plates of the U-shaped portions of the first and second attachment elements are close to each other, thus limiting the extension of the removable tool assembly in a direction perpendicular to said bottom plates.

16. A backhoe digging apparatus for a construction equipment machine comprising a dipper arm, said dipper arm having spaced apart parallel first and second fastening pins, and at least one removable tool assembly according to claim 1 attached to said first and second fastening pins.

17. The backhoe digging apparatus according to claim 16, wherein the removable tool assembly is chosen among a ripping tooth assembly, a compactor assembly, a cutter assembly, a splitter assembly, a rake assembly, a bucket assembly and a thumb assembly comprising a thumb.

18. The backhoe digging apparatus according to claim 16, wherein the attachment mechanism comprises a pair of lugs adapted to pivotally attach a tool, for instance an articulated thumb, the axis defined by the lugs being aligned with the axis defined by the second fastening pin.

19. A method for attaching a tool to a dipper arm of a backhoe digging apparatus of a construction equipment machine, said dipper arm having spaced apart parallel first and second fastening pins, the method comprising the following steps of:

a) moving the dipper arm to position the first fastening pin in an initial position in which said first fastening pin is received in first receiving areas of a first attachment element of the tool;

b) rotating the dipper arm so that the tool pivots relative to the dipper arm about the first fastening pin till a second attachment element of the tool abuts against the second fastening pin;

c) optionally, further rotating the dipper arm so that the first fastening pin moves along a guiding path defined by the first attachment element and reaches a final position in the first receiving areas;

d) moving the second attachment element relative to the first attachment element to position the second fastening pin in a final position in which said second fastening pin is received in second receiving areas of the second attachment element, wherein the step d) comprises the steps of:

d1) connecting a lever to a locking cam that is pivotally connected to the first attachment element and is maintained in contact with the first and second attachment elements by a spring structure, and rotating the lever to pivot the locking cam in a locking position in which the spring structure pushes the second attachment element toward the first attachment element till the second fastening pin is received in the second receiving areas of the second attachment element;

e) optionally, locking the second attachment element to the first attachment element.

20. A method for attaching a tool to a dipper arm of a backhoe digging apparatus of a construction equipment machine, said dipper arm having spaced apart parallel first and second fastening pins, the method comprising the following steps of:

a) moving the dipper arm to position the first fastening pin in an initial position in which said first fastening pin is received in first receiving areas of a first attachment element of the tool;

b) rotating the dipper arm so that the tool pivots relative to the dipper arm about the first fastening pin till a second attachment element of the tool abuts against the second fastening pin;

c) optionally, further rotating the dipper arm so that the first fastening pin moves along a guiding path defined by the first attachment element and reaches a final position in the first receiving areas;

d) moving the second attachment element relative to the first attachment element to position the second fastening pin in a final position in which said second fastening pin is received in second receiving areas of the second attachment element, wherein the step d) comprises the steps of:

d1') connecting a lever to a locking cam that is pivotally connected to the first attachment element and in contact with an abutment surface of the second attachment element; and d2') rotating the lever to pivot the locking cam in a locking position in which said locking cam pushes the second attachment element toward the first attachment element till the second fastening pin is received in the second receiving areas of the second attachment element; and e) optionally, locking the second attachment element to the first attachment element.

* * * * *